US007219702B2

(12) United States Patent
Maes et al.

(10) Patent No.: US 7,219,702 B2
(45) Date of Patent: May 22, 2007

(54) PNEUMATICALLY CONTROLLABLE WEFT THREAD CLAMP FOR A WEAVING MACHINE

(75) Inventors: Dominique Maes, Dentergem (BE); Ferdi Dejaegere, Dadizele (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 0 days.

(21) Appl. No.: 11/131,894

(22) Filed: May 18, 2005

(65) Prior Publication Data

US 2005/0257849 A1 Nov. 24, 2005

(30) Foreign Application Priority Data

May 19, 2004 (BE) ..... 2004/0251

(51) Int. Cl.
*D03D 47/34* (2006.01)
*D03D 47/27* (2006.01)

(52) U.S. Cl. ..... 139/453; 139/447; 139/448

(58) Field of Classification Search ..... 139/447, 139/448, 453, 149, 217, 216; 242/419.3, 242/419.4, 149
See application file for complete search history.

(56) References Cited

U.S. PATENT DOCUMENTS

| | | | | |
|---|---|---|---|---|
| 2,868,233 | A * | 1/1959 | Dewas | 139/448 |
| 2,960,118 | A * | 11/1960 | Ancet et al. | 139/445 |
| 3,034,540 | A * | 5/1962 | Lipsky | 139/447 |
| 3,662,785 | A * | 5/1972 | Kokkinis | 139/448 |
| 3,851,676 | A * | 12/1974 | Kokkinis | 139/448 |
| 3,857,419 | A * | 12/1974 | Mackie | 139/448 |
| 4,418,727 | A * | 12/1983 | Santucci | 139/448 |
| 4,494,579 | A | 1/1985 | Grandvallet et al. | |
| 4,587,998 | A * | 5/1986 | Egloff et al. | 139/448 |
| 5,113,914 | A * | 5/1992 | Corain | 139/448 |
| 6,164,342 | A * | 12/2000 | De Jager et al. | 139/448 |
| 6,948,531 | B2 * | 9/2005 | Hofstetter | 139/448 |
| 7,007,723 | B2 * | 3/2006 | Debaes et al. | 139/453 |

FOREIGN PATENT DOCUMENTS

| | | |
|---|---|---|
| EP | 1266986 | 12/2002 |
| FR | 2741332 | 5/1997 |
| JP | 61/060572 | 3/1986 |
| WO | WO 02/095105 | 11/2002 |
| WO | WO 04/029346 | 4/2004 |

* cited by examiner

*Primary Examiner*—Robert H Muromoto
(74) *Attorney, Agent, or Firm*—James Creighton Wray

(57) ABSTRACT

This invention concerns a weft thread clamp with two jaws (1), (2) that can be moved to an opened and closed position, with at least one jaw (1) being directly moveable to the closed position via fluid pressure. The moveable jaw is preferably (1) a moveable unit, preferably made of a light material or in a compact form, which is moveable as a complete unit under the influence of the fluid pressure. Such a weft thread clamp is more reliable and simpler, and has a quicker reaction speed than the known pneumatically controllable weft thread clamps. This invention also concerns a system for the presentation of weft threads to a weaving machine equipped with one or more such weft thread clamps, as well as a weaving machine equipped with such a presentation system.

15 Claims, 1 Drawing Sheet

PNEUMATICALLY CONTROLLABLE WEFT THREAD CLAMP FOR A WEAVING MACHINE

This application claims the benefit of Belgian Application No. 2004/0251 filed May 19, 2004, which is hereby incorporated by reference in its entirety.

BACKGROUND OF THE INVENTION

This invention concerns a weft thread clamp for a weaving machine containing two jaws that can be put in an open and closed position, with at least one jaw being directly moveable by fluid pressure to the closed position.

This invention also concerns a weaving machine equipped with one or more such weft thread clamps.

EP 1,266,986 describes a weft thread clamp with a pneumatically controlled jaw that contains an air bellows in which atmospheric pressure is built up to increase the volume of the air bellows in order to move a leaf spring to a clamping position. Thus, here this leaf spring functions as a means of clamping. Only the closing movement is controlled positively by this clamp. The movement to the opened position occurs by allowing the atmospheric pressure to decrease such that the opening of the clamp is done exclusively under the influence of the spring force of the leaf spring.

This weft thread clamp, however, has a disadvantage in that it has a limited reaction speed due to the time required for the air bellows to expand or contract. This makes it impossible during operation to guarantee that the clamp is always fully opened or closed at the points in time that an opened or closed position is required. Thus, the weft yarn regularly moves between jaws that are in an intermediate position between the closed and the opened position, causing increased friction between the yarn and the jaws. In addition, the late opening of the clamp causes greater tension to be built up in the yarn.

The increased friction causes more yarn particles and small fibres from the yarn to be released and deposed, among other places, on the weft thread clamp. This leads to a higher level of contamination. Higher yarn tension leads to more yarn breakage and thus more machine stoppages, resulting in reduced productivity and a greater risk of fabric irregularities that occur when the weaving machine is restarted.

Another disadvantage of the weft thread clamp according to EP 1,266,986 is that the air bellows is a component that is subject to wear. It is also not easy to durably and reliably assemble the air bellows using a heat shrink connection. Moreover, it is also extremely difficult to produce completely identical air bellows, meaning that the behaviour of the different air bellows under the influence of the same fluid pressure is often different. This requires an individual adjustment of the installed air bellows.

U.S. Pat. No. 4,494,579 describes a pneumatically controlled weft thread clamp in which the pressure difference in two chambers interconnected by a membrane is used to effect the movement of the means of clamping to the opened position. The closing movement is effected by a spring. A disadvantage of this weft thread clamp is that the closing movement of the means of clamping is not positively controlled, so that the clamping force cannot be influenced by the fluid pressure. Moreover, the reaction speed of this weft thread clamp is too slow to work with high weaving speeds. Another disadvantage is that two membranes must be provided, making this clamp quite complex. Because the required membranes are very sensitive to wear, there is a high risk of pressure loss with this type of weft thread clamp.

FR 2741332 discloses a thread clamp with the features mentioned in the first paragraph of this description. This clamp however takes up a lot of space. This is an important drawback, in particular in devices were a number of weft thread clamps must be installed one above the other.

The object of this invention is to provide a pneumatically controllable weft thread clamp that does not have the disadvantages indicated above.

SUMMARY OF THE INVENTION

This objective is accomplished by providing for a weft thread clamp with the features mentioned in the first paragraph of this description, whose moveable jaw is moveable to the closed position against the spring force of a spring element that is connected to the other jaw.

With such an embodiment, it is primarily the mass of the moveable jaw that determines the reaction speed of the weft thread clamp. If the jaw is manufactured as a light component, by keeping the size small or by using light materials, for example plastics, or a combination of both, the low inertia of this component allows it to be moved very easily and very quickly via fluid. In this way, a weft thread clamp with an exceptionally high reaction speed can be obtained that is capable of working reliably on a weaving machine with a very high weaving speed. Moreover, positive control of the closing movement is used, and the weft thread clamp can be produced very simply.

Because this clamp reacts more quickly to control, it also reaches the fully opened or fully closed position more quickly. This prevents the weft yarn from moving with respect to half-opened or half-closed jaws and thus avoids the harmful friction between the weft yarn and these jaws. The absence of the membranes, which are sensitive to wear, means that this weft thread clamp also has a longer lifespan than the existing weft thread clamps.

Such a moveable jaw can be made, for example, as a component whose properties that determine the behaviour under the influence of fluid pressure are easy to reproduce, such as for example the dimensions and the weight of a component made of plastics. This results in multiple weft thread clamps according to this invention with the same reliable and predictable operation, with the different clamps responding quite similarly to the same fluid pressure. This makes additional adjustments per weft thread clamp unnecessary.

In the context of this patent application, a fluid is any liquid or gaseous medium. The weft thread clamp according to this invention, however, is preferably driven by a gaseous medium, for example, air.

According to this invention, the mentioned moveable jaw is moveable to the closed position, overcoming the spring force of a spring element that is connected to the other jaw.

By installing the spring element on the other, opposing jaw, the spring element need not function as means of clamping, as is the case with the embodiment according to EP 1,266,986. Thus, the spring element no longer needs to be made in a shape, with finishing and material properties, suitable to this function.

The design of the spring element can now be adapted exclusively to the required spring force, leading to the use of a simpler, less expensive and more efficient spring. The jaw can then also be more easily made with properties that are primarily adapted to its clamping function. Thus, the moveable jaw can be made, for example, completely or partially of a material that is very suitable and able to resist contact with yarns, or be treated in order to limit yarn wear.

A further advantage of the spring element being connected to the other jaw, is that the weft thread clamp can be manufactured as a very compact element.

In a preferred embodiment, the moveable jaw, produced in a very simple form, is moveable with respect to a fixed jaw in order to clamp a weft thread between the face of the moveable jaw and a clamping surface of the fixed jaw.

The spring element mentioned can be a leaf spring that is attached to the fixed jaw and is able to exercise a spring force on the moveable jaw. A notch can be provided under this leaf spring into which the leaf spring can move out of the way when the moveable jaw moves to the closed position.

In a preferred embodiment of the weft thread clamp according to this invention, a situation is created in which the fluid pressure directly contacts the jaw itself. By eliminating all intervening components, an exceptionally simple weft thread clamp is obtained with an exceptionally high reaction speed.

In a very preferred embodiment, the mentioned moveable jaw is a moveable unit that is moveable as a whole via the fluid pressure. Preferably, this moveable jaw is the only component that is moved via the fluid pressure.

The fixed jaw preferably contains at least one raised rib, edge or protuberance in order to hold a weft thread on the above-mentioned clamping surface of the fixed jaw within reach of the moveable jaw.

In a particular embodiment, the weft thread clamp according to this invention includes a fixed body in which a fluid channel is provided, and the moveable jaw is moveable in a chamber that is connected to the fluid channel.

The said chamber is preferably interconnected by a sleeve whose measurements are adapted to the exterior dimensions of the moveable jaw, so that this jaw is able to slide back and forth under the influence of the fluid pressure that is created in the chamber above the jaw. Preferably, means will also be provided to seal the entire unit against fluid leaks.

In a very preferred embodiment, a protuberance is provided on the face of the moveable jaw upon which the fluid is able to exert pressure, in order to maintain a distance between this face and the opposite wall of the chamber. This effectively prevents the mentioned face of the moveable jaw contacting the chamber wall, which could make it difficult for the fluid to initially penetrate this chamber wall and the face, delaying the reaction speed of the weft thread clamp. The presence of the protuberance creates a space between the face and the above-mentioned chamber wall so that, upon control, the fluid pressure is able to operate the moveable jaw almost immediately.

The moveable jaw and/or the walls of the said chamber are preferably manufactured of durable materials or are at least wholly or partially covered with a durable layer. This reduces wear to an absolute minimum and increases the reliability of the weft thread clamp.

To obtain maximum reaction speed, in a preferred embodiment the moveable jaw is at least partially made of a material with a low relative density such as plastics.

In a most preferred embodiment, the moveable jaw has a primarily cylindrical form. Such an element can be made using relatively simple production processes wherein it can be guaranteed that deviations in weight and dimensions are kept to a minimum.

If the weft thread clamp is installed in such a way that the moveable jaw is located under the fixed jaw, gravity contributes to the spring force in moving the moveable jaw to the opened position. This allows the use of a spring element with less spring force. This can make possible a further reduction in weight for the weft thread clamp.

This invention also concerns a system for the presentation of weft threads to a weaving machine equipped with one or more weft thread clamps of which at least one weft thread clamp is made according to this invention. Furthermore, a weaving machine with such a system for the presentation of weft threads also falls within the scope of this invention.

In that which follows, a possible embodiment of a weft thread clamp according to this invention is described in detail. This description is only intended to further explain the above-mentioned characteristics of the invention and indicate additional properties and particulars thereof and thus cannot be seen as a restriction of the protection for this invention contained in the claims of this patent.

BRIEF DESCRIPTION OF THE DRAWINGS

In this description, reference is made to numbers on the enclosed drawings, with FIGS. 1 and 2 respectively depicting a vertical cross section and a view from above of a weft thread clamp according to this invention, and FIG. 3 depicting a view from above of the fixed jaw of the weft thread clamp represented in FIGS. 1 and 2.

DETAILED DESCRIPTION OF THE PREFERRED EMBODIMENTS

Figure 1:
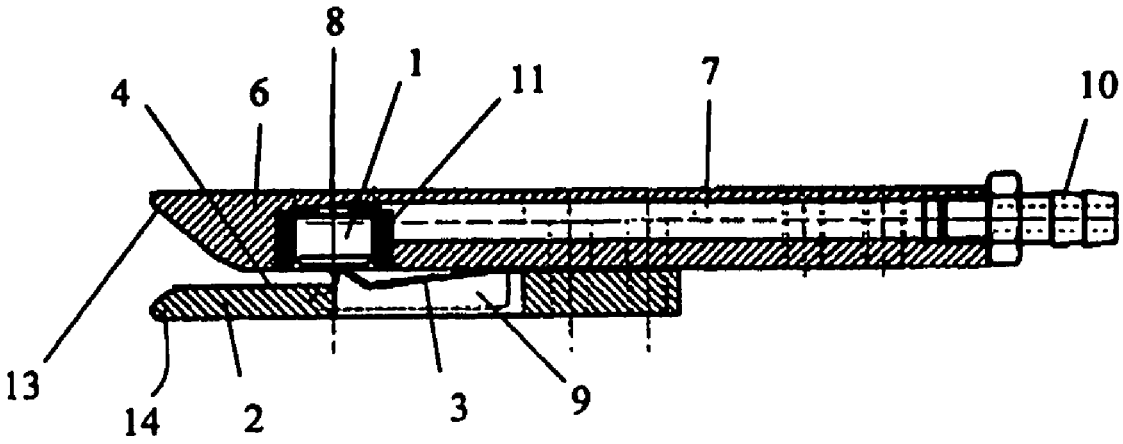
Figure 2:
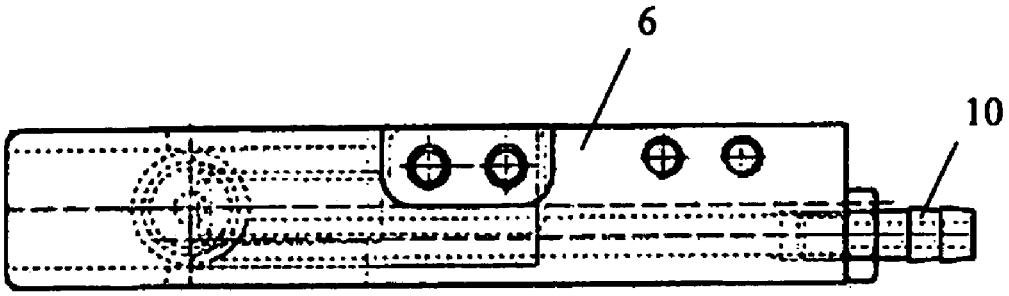

The weft thread clamp represented in the figures consists of an upper body (6) in which a compressed air channel (7) is provided that can be connected on one end via a connection piece (10) to a supply line that is not depicted in the figures. Close to the other end there is a cylindrical sleeve (11) in the body (6) contained in a notch provided for it. The sleeve (11) borders a cylindrical chamber that is open along the underside and that is connected to the compressed air channel (7) along the top. A suitable cylindrical pin (1) is provided in the cylindrical chamber that borders this sleeve (11). This pin, under the influence of the compressed air pressure, can be moved vertically in this chamber and functions as moveable jaw. Possible means of sealing can be provided (not on the figures shown) to prevent compressed air leaks.

On the upper face of the pin (1) there is also a cylindrical protuberance (8) that is designed to maintain a distance between the face and the upper wall of the cylindrical sleeve (11) and thus to prevent the situation in which the compressed air, at the beginning of the control, has difficulty penetrating this chamber wall and the mentioned face of the pin (1), which would result in the pin (1) coming into motion with a certain delay. At the bottom, the pin (1) has an end piece that conically narrows towards the lower face.

The weft thread clamp also consists of a jaw (2) mounted under the body (6). A leaf spring (3) is attached to the upper surface of this fixed jaw (2). The leaf spring (3) has a bent shape with an upward slanting end that adjoins the lower face of the pin (1), causing a counteracting spring force to be applied to the pin (1) when it is moved downward. Under the leaf spring (3) there is a notch (9) foreseen in which the leaf spring (3) can move out of the way when it is bent by the downward movement of the pin (1). On the clamp side (left on FIG. 1), the body (6) has a beveled end (13); the opposite edge (14) of the fixed jaw (2) is also rounded to form a guide channel for the weft thread.

By moving the cylindrical pin (1) downward under the influence of applied compressed air, the jaws (1), (2) arrive in a closed position wherein weft yarn can be clamped between the lower face of the pin (1) and the opposite contact surface (4) on the top of the fixed jaw (2). By reducing this compressed air, under the influence of the spring force of the leaf spring (3), the pin (1) can be allowed to return to the position wherein it is located fully in the sleeve (11) (as depicted in FIG. 1). The jaws (1), (2) are then in the opened position, wherein previously clamped weft yarn is again released.

Figure 3:
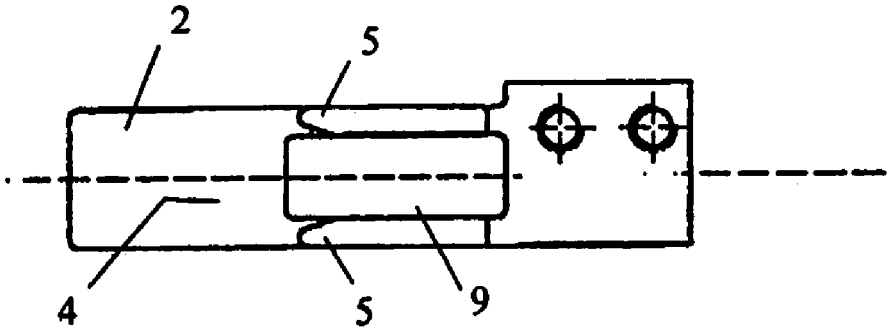

On the top of the fixed jaw (2) there are raised ribs (5) foreseen on both sides of the notch (9) that extend along to the longitudinal axis of the fixed jaw (2). These raised ribs (5) prohibit (see FIG. 3) the weft yarn, which runs in transverse direction along the top of the fixed jaw (2) past these ribs (5,) from shifting to the right and coming under the leaf spring (3). The left ends of the ribs (5) thus constitute a barrier for the weft yarn, keeping this weft yarn within the reach of the pin (1) on the contact surface (4).

The same raised ribs (5) also support the cylindrical sleeve (11) contained in the body (6). This holds the cylindrical sleeve (11) in its notch in the body (6). The raised ribs (5) prevent the sleeve (11) from moving downward while the moveable jaw (1) in this sleeve (11) is able to move downward unhindered between these raised ribs (5).

Such a weft thread clamp with a light cylindrical pin moved by compressed air has an exceptionally high reaction speed, and is simple and inexpensive to produce and assemble. The amount of compressed air used is also lower than with the known weft thread clamps. Several such weft thread clamps will also be driven by the same compressed air and respond in approximately the same way. Benefits include, among others, the fact that in multiple-gripper weaving machines, more grippers can be controlled simultaneously with several weft thread clamps that operate with the same control source. In this way, such systems for the presentation of weft threads can be made more simply and less expensively.

The invention claimed is:

1. Weft thread clamp containing two jaws (1), (2) that can be put in an opened and a closed position, with at least one jaw (1) being directly moveable by fluid pressure to the closed position, characterised in that said moveable jaw (1) is moveable to the closed position against the spring force of a spring element (3) that is connected to the other jaw (2).

2. Welt thread clamp according to claim 1 characterised in that the moveable jaw (1) is moveable with respect to a fixed jaw (2) in order to clamp a weft thread between the face of the moveable jaw (1) and a clamping surface (4) of the fixed jaw (2).

3. Welt thread clamp according to claim 2 characterised in that said spring element (3) is a leaf spring that is attached to the fixed jaw (2) and is equipped in such a way that it exerts a spring force on the moveable jaw (1).

4. Weft thread clamp according to claim 3 characterised in that a notch is provided under the leaf spring (3) in which the leaf spring (3) can move out of the way when the moveable jaw (1) moves to the closed position.

5. Weft thread clamp according to claim 1 characterised in that the fluid pressure itself directly contacts the jaw (1).

6. Welt thread clamp according to claim 1 characterised in that said movable jaw (1) is a moveable unit that is moveable as a whole via the fluid pressure.

7. Welt thread clamp according to claim 2 characterised in that the fixed jaw (2) contains at least one raised rib, edge or protuberance (5) in order to retain a welt thread on the mentioned clamping surface (4) of the fixed jaw, within the reach of the moveable jaw (1).

8. Weft thread clamp according to claim 1 characterised in that it contains a fixed body (6) in which a fluid channel (7) is provided, and that the moveable jaw (1) is moveable in a chamber that is connected to the fluid channel (7).

9. Weft thread clamp according to claim 1 characterised in that a protuberance (8) is provided on the face of the moveable jaw (1) upon which the fluid is able to exert pressure, in order to maintain a distance between the face and the opposite wall of the chamber.

10. Weft thread clamp according to claim 8 characterised in that the moveable jaw (1) and/or the walls of the said chamber are manufactured of durable materials or at least wholly or partially made with a durable top layer.

11. Weft thread clamp according to claim 1 characterised in that the moveable jaw (1) is at least partially manufactured of plastics.

12. Weft thread clamp according to claim 1 characterised in that the moveable jaw (1) has primarily a cylindrical shape.

13. Weft thread clamp according to claim 1 characterised in that it is installed such that the moveable jaw (1) is located under the fixed jaw (2).

14. System for the presentation of weft threads to a weaving machine equipped with one or more weft thread clamps, characterised in that it contains at least one weft thread clamp according to claim 1.

15. Weaving machine containing a system for the presentation of weft threads according to claim 14.

* * * * *